US006877413B1

(12) United States Patent
Shih

(10) Patent No.: US 6,877,413 B1
(45) Date of Patent: Apr. 12, 2005

(54) SLIDEABLE HOLE PUNCH

(75) Inventor: Chao-Tung Shih, Jhonghe (TW)

(73) Assignee: Cheng Tien Int'l Corp., Taichung (TW)

( * ) Notice: Subject to any disclaimer, the term of this patent is extended or adjusted under 35 U.S.C. 154(b) by 0 days.

(21) Appl. No.: 10/673,294

(22) Filed: Sep. 30, 2003

(51) Int. Cl.[7] ..... B26D 5/08

(52) U.S. Cl. ..... 83/622; 83/627; 83/687; 83/582

(58) Field of Search ..... 83/627, 629, 560, 83/684, 563, 647, 590, 669, 681, 698.71, 83/112, 123, 155, 165, 255, 685, 549, 571, 83/559, 633, 358, 588, 618, 388, 613, 687, 83/638, 691, 698.7; 30/358, 363; 101/109, 101/3.1; D19/72, 65, 95, 99, 100; D8/98

(56) References Cited

U.S. PATENT DOCUMENTS

| | | | | | |
|---|---|---|---|---|---|
| 1,500,576 | A * | 7/1924 | Cusi | 30/358 |
| 1,728,475 | A * | 9/1929 | Cavill | 83/468 |
| 1,742,216 | A * | 1/1930 | Rauber | 83/553 |
| 2,368,790 | A * | 2/1945 | Unger | 83/146 |
| 2,481,883 | A * | 9/1949 | Semler | 83/560 |
| 2,726,721 | A * | 12/1955 | Segal | 83/560 |
| 2,756,822 | A * | 7/1956 | Jones | 83/399 |
| 3,073,199 | A * | 1/1963 | Yerkes | 83/549 |
| 3,921,487 | A * | 11/1975 | Otsuke et al. | 83/468.9 |
| 3,987,695 | A * | 10/1976 | Neilsen | 83/522.17 |
| 4,020,554 | A * | 5/1977 | LaTourette | 30/358 |
| 4,449,436 | A * | 5/1984 | Semerjian et al. | 83/571 |
| 4,594,927 | A * | 6/1986 | Mori | 83/620 |
| 4,682,524 | A * | 7/1987 | Achelpohl | 83/151 |
| 5,144,750 | A * | 9/1992 | Mandel | 30/368 |
| 5,144,872 | A * | 9/1992 | Kakimoto | 83/13 |
| 5,463,922 | A * | 11/1995 | Mori | 83/622 |
| 5,499,565 | A * | 3/1996 | Hansen et al. | 83/452 |
| 5,632,188 | A * | 5/1997 | Karlis | 83/167 |
| 5,894,778 | A * | 4/1999 | Mori | 83/629 |
| 6,622,908 | B2 * | 9/2003 | Fukumoto et al. | 234/95 |
| 2002/0020272 | A1 * | 2/2002 | Godston et al. | 83/620 |
| 2002/0139232 | A1 * | 10/2002 | Hsu | 83/549 |
| 2002/0157517 | A1 * | 10/2002 | Huang | 83/618 |
| 2003/0126967 | A1 * | 7/2003 | Oh | 83/588 |

* cited by examiner

*Primary Examiner*—Allan N. Shoap
*Assistant Examiner*—Ghassem Alie

(57) ABSTRACT

A slideable hole punch, having an upper seat, at least one drill set and a lower seat. The upper seat has a slide track allowing one slide member to move thereon. The upper seat is fitted over the lower seat. The lower seat accommodates the drill set and has an internal slot. The drill set is disposed between the upper and lower seats. A paper slot is formed between the upper and lower seats. Thereby, paper can be disposed in the paper slot and slide along the slide track by the slide member. The slide member can then press upon the drill set to perforate through the paper to form holes with desired shapes and distances.

17 Claims, 8 Drawing Sheets

SLIDEABLE HOLE PUNCH

BACKGROUND OF THE INVENTION

The present invention relates to a slideable paper punch and, more particularly, to a hole punch applied to stationary which perforates paper with holes by sliding a slide member along a slide track.

In the prior art, hole punches with different specifications are manufactured to punch holes through different sizes of paper, and various types of folders for documents punched with two, three or four holes are also manufactured. The large hole punches, though provide versatile functions, occupy large spaces, while the small punches are normally suitable to punch hole with a specific number of holes through paper with a specific size.

FIG. 1 shows a conventional hole punch. As shown, the hole punch includes a base 10*a*, a pressing board 20*a* and a set of drills 30*a*. The top surface of the base 10*a* includes two through-holes 11*a* and two positioning plates 12*a*. The positioning plates 12*a* provide pivotal connection to the pressing board 20*a*. The rear portion of the top surface of the base 10*a* is recessed to form a slot between the fitting plates 12*a* and the base 10*a*. Paper can thus be inserted into the slot for hole punch. To punch the paper, the pressing board 20*a* is pressed downward to move the set of drills 30*a* down, so as to punch holes through the paper.

Though conventional hole punch provides hole punching function, it has the following drawbacks.

1. The relative positions of the through holes 11*a* of the base 10*a* and the drills 31 are fixed. Therefore, such design can only be applied to punch holes with specific distances. To punch holes with different distance, a different punch is required.

2. The dimensions of the base 10*a* and the pressing board 20*a* vary according to the required distance between perforated holes. When a larger distance is required, the hole punch is manufactured with a large size to consume a large storage space.

BRIEF SUMMARY OF THE INVENTION

The present invention provides slideable hole punch of which the drills are pressed by movement of a slide member, such that the paper can be perforated with holes.

The slideable hole punch provided by the present invention includes an integrally formed body with a small size. Therefore, the storage space of the hole punch is minimized.

Further, the slidable hole punch can be adjusted for perforating holes with different shapes and distances. The application is thus much broader than the conventional design.

The slidable hole punch comprises an upper seat, at least one drill set, and a lower seat. The upper seat includes a slide track allowing a slide member sliding thereon. The upper seat is fitted on the lower seat. The lower seat accommodates the drill set and has a slot for the drill set to insert through. The drill set further comprises a paper slot for disposing paper to be perforated. The drill set is installed between the upper and lower seats.

BRIEF DESCRIPTION OF THE DRAWINGS

These, as well as other features of the present invention, will become apparent upon reference to the drawings wherein.

DETAILED DESCRIPTION OF THE INVENTION

Figure 1:
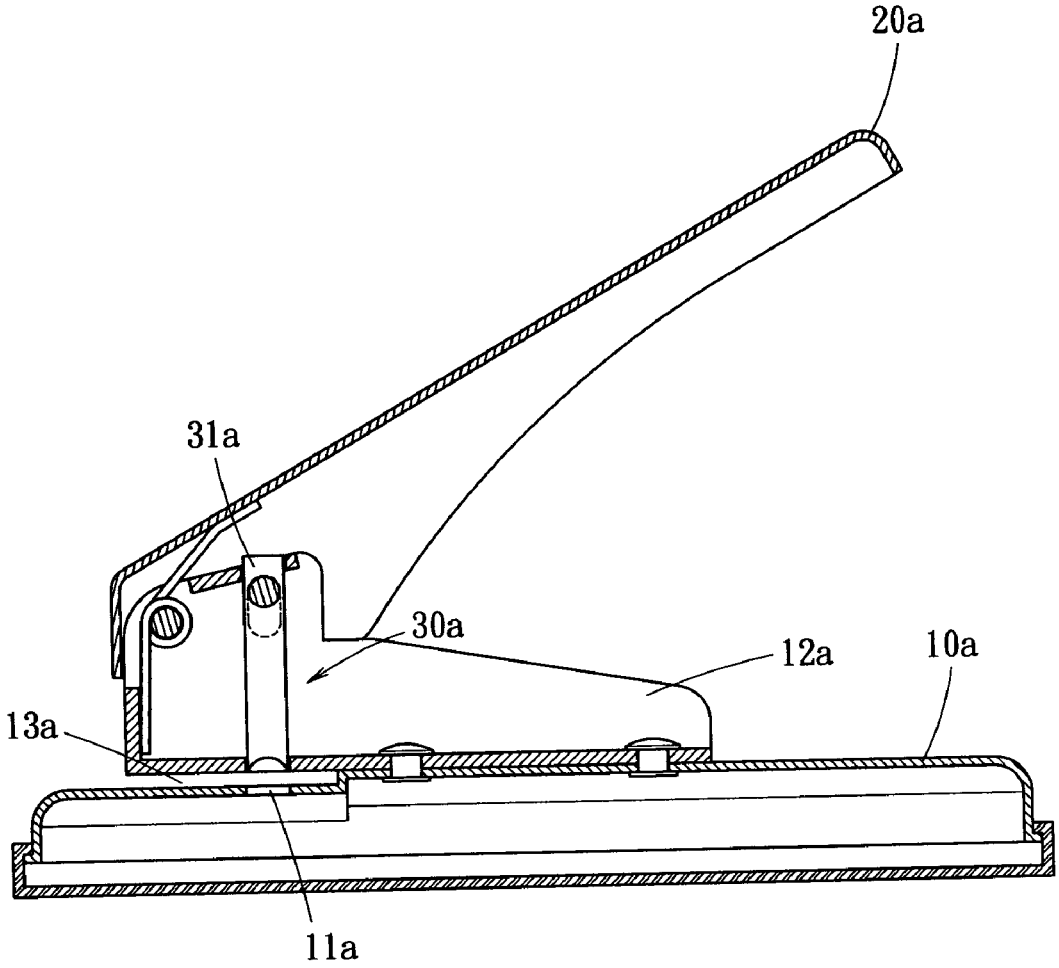
FIG. 1 PRIOR ART
FIG. 1 shows a conventional hole punch.
Figure 2:
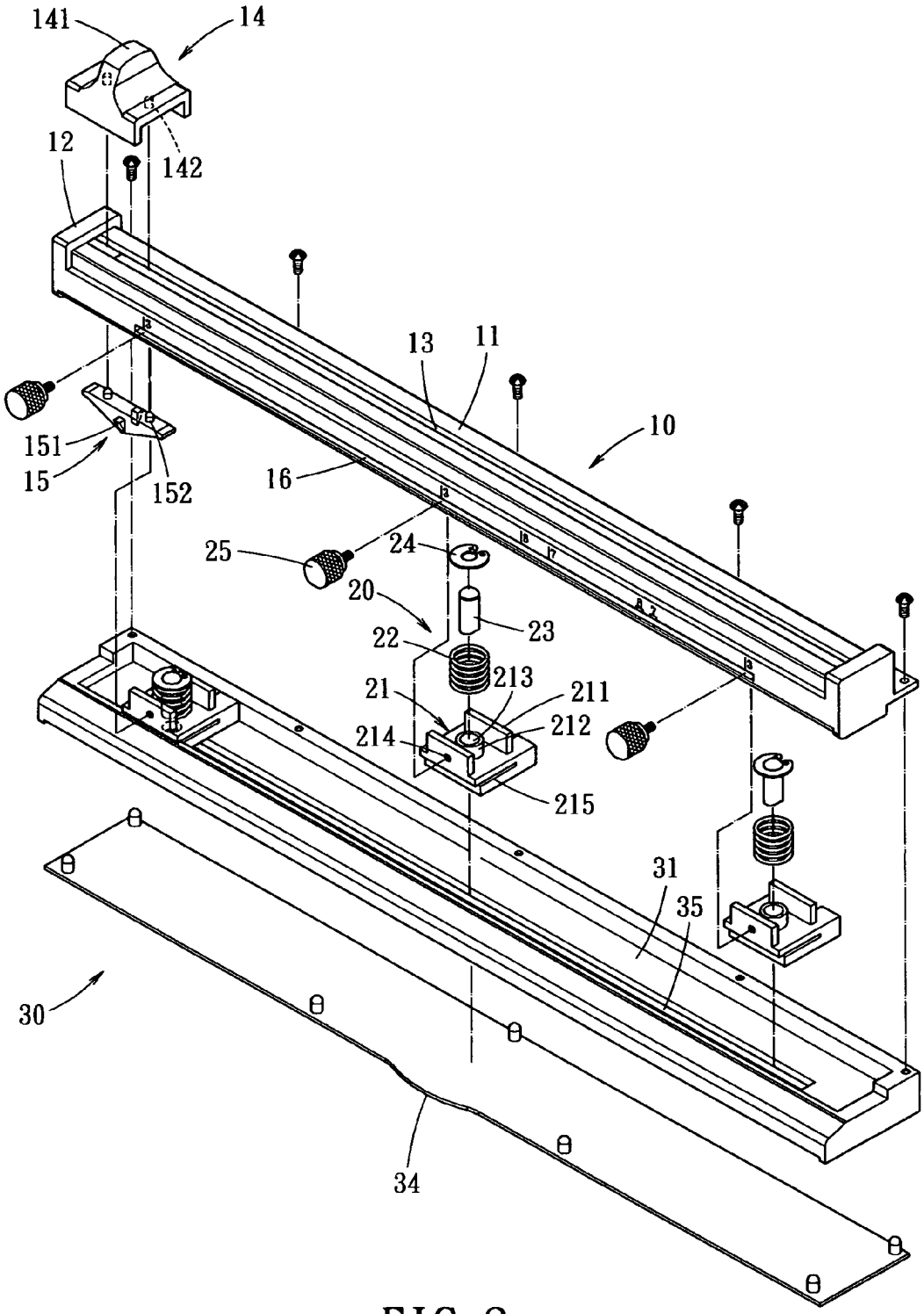
FIG. 2 shows an exploded view of a hole punch provided by the resent invention.
Figure 3:
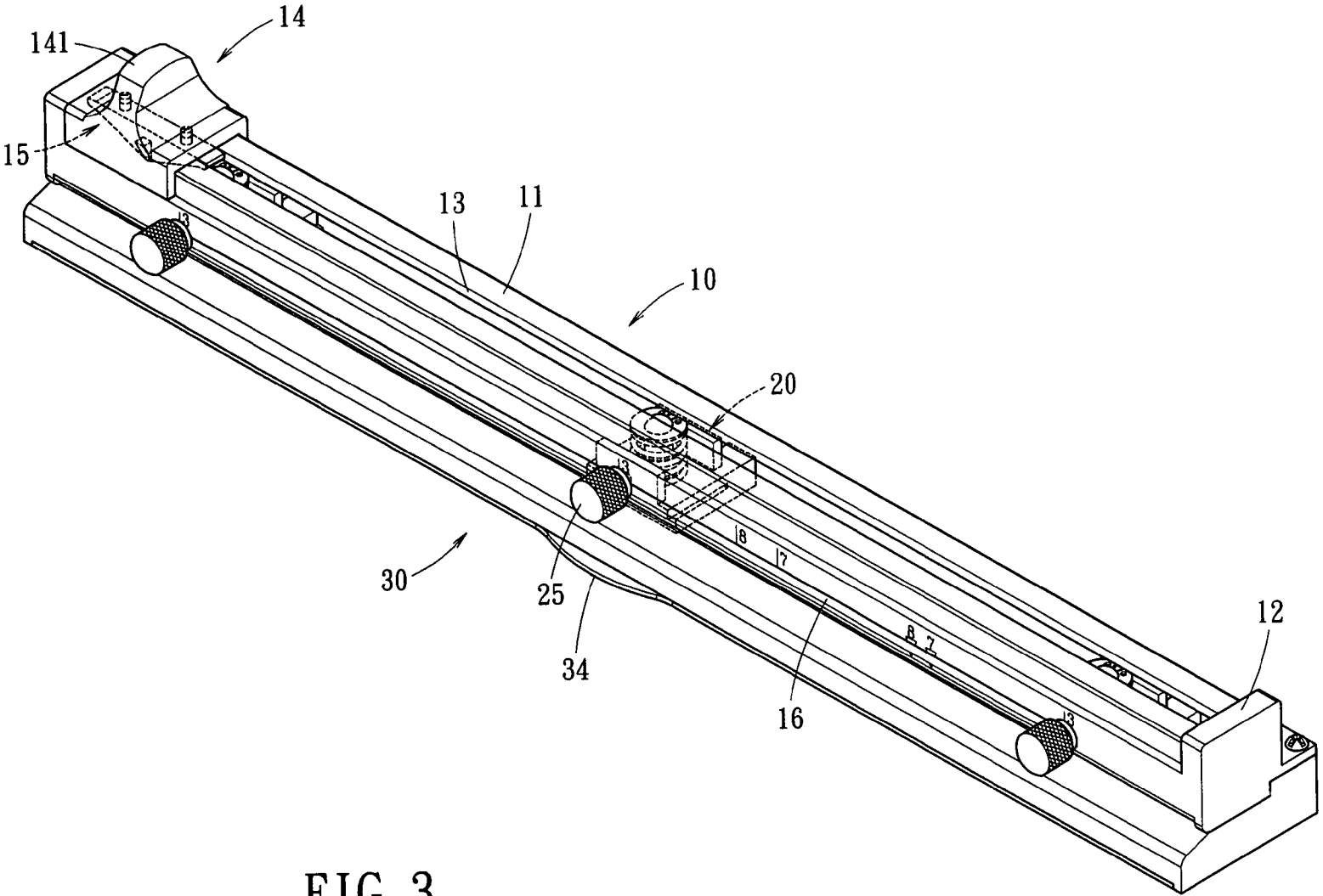
FIG. 3 shows the assembly of the hole punch.

Referring to FIGS. 2 and 3, an exploded view and an assembly of a hole punch are illustrated. The slideable hole punch as shown includes an upper seat 10, at least one drill set 20 and a lower seat 30.

The upper seat 10 includes two opposing elongate side walls, an open top end and an open bottom end. An elongate slide track 11 with a top surface and two side surfaces is formed with two side surfaces thereof sitting on the sidewalls. The slide track 11 extends through the elongate length of the upper seat 10. Two block members 12 are formed at two opposing ends of the upper part of the upper seat 10. The center of the top surface of the slide track 11 is opened with a channel 13 extending through the elongate length of the slide track 11. The upper seat 10 further comprises a slide member 1 to slide along the slide track 11 between the block members 12. The slide member includes an upper slide member 14 and a lower slide member 15. The upper slide member 14 includes a top surface and two side surfaces extending from two sides of the top surface to fit over the slide track 11. Extending upwardly from the upper slide member 14 includes a handle 141 for the user. The top surface of the upper slide member 14 is perforated with two holes 142, through which fasteners such as bolts or screws can be used to engage the upper slide member 14 with the lower slide member 15. The lower slide member 15 is disposed under the slide track 11 and includes a plate with a triangular or oval sidewall. The lower slide member has an elongate top surface, two sidewalls and two slanted bottom surfaces. The top surface is aligned with the channel 13 and includes two protruding columns 152 aligned with the through holes 142, while the sidewalls each includes a bump 151. By inserting the protruding columns 152 into the holes 142 through the channel 13, the upper and lower slide members 14 and 15 can be engaged with each other by fasteners such as screws across the slide track 11. As shown in FIG. 2, one of the sidewalls of the upper seat 10 further includes an elongate slot 16.

Each drill set 20 includes a drill fitting base 21, a resilient member 22, a drill 23, a retainer 24 and a positioning member 25. The drill fitting base 21 includes a rectangular plate with two parallel boards 211 protruding from a top surface thereof and extending along the elongate of the upper seat 10. A central column 212 is formed protruding from the top surface of the top surface of the rectangular plate between the parallel boards 211. The resilient member 22 fits over the central column 212. The resilient member 22 includes spiral spring, plate spring or other similar structure. In this embodiment, a spiral spring is used. The resilient member 22 is used to restore the drill 23 after being pressed downward. One of the parallel boards 211 is perforated with a hole as a fitting part 214, which is aligned with the elongate slot 16 of the sidewall of the upper seat 10. The fitting part 214 allows the positioning member 25 to insert through. The positioning member 25 includes a screw or similar device. One of the side surfaces of the rectangular plate is recessed with a slot 215 for disposing paper therein.

The lower seat 30 includes an elongate frame with four sidewalls, one bottom wall and an open top. The bottom wall is perforated with an elongate slot 31 aligned with the drills 23. The four sidewalls extend over the bottom wall to form a compartment 35 underneath the bottom wall. The compartment 35 is closed by a lid 34 for storing the paper cut by the drills 23.

Figure 5:
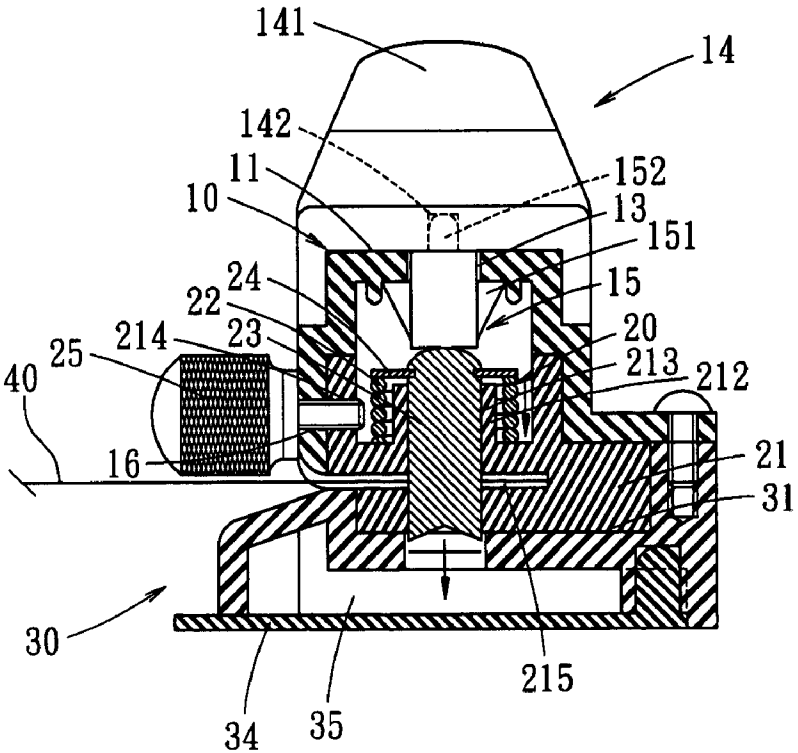
FIG. 5 shows another operation status of the hole punch.
Figure 4:
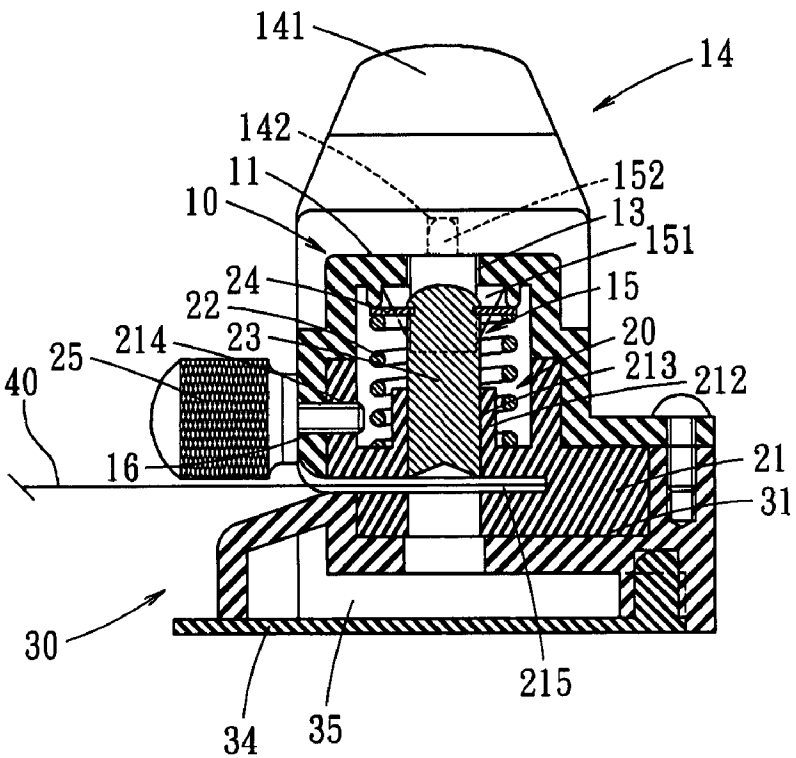
FIG. 4 shows an operation status of the hole punch.
Figure 6:
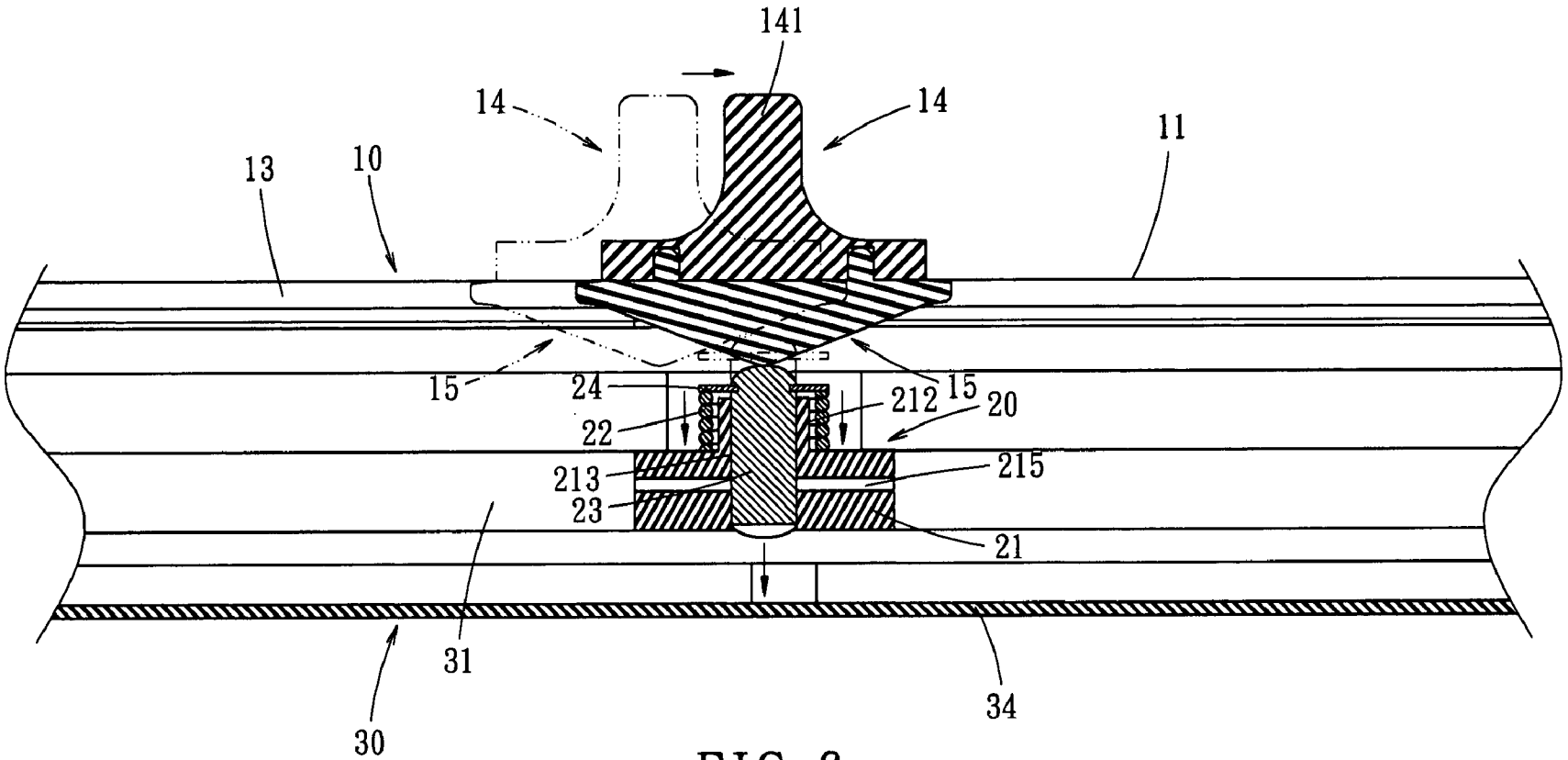
FIG. 6 shows the operation of the slide member and the drill set.

Referring to FIGS. 4, 5 and 6, operation statuses of the drill set and the slide member are shown. As shown in FIG. 4, one sidewall of the upper seat 10 includes a horizontal extension for connecting the sidewall of the lower seat 30 by screw or similar fastener. Thereby, the drills 23 are disposed in the slot 31 of the bottom surface of the lower seat 31 of the lower seat 30. The positioning member 25 is inserted through the elongate slot 16 into the fitting part 214 of the drill fitting base 21 to fix the position of the drill 23. Alternatively, before fixing the position of the drill 23, the position member 25 inserted through the elongate slot 16 into the fitting part 214 may be moves along the elongate direction to drive the drill 23 to a desired position. The positioning member 25 is then fully engaged with the fitting part 214 to fix the position of the drill 23. By sliding the slide member 14 along the slide track 11 to drive the bottom surface of the lower slide member 15 in contact with the drill 23. The drill 23 is thus pressed downward to punch hole through paper 40 inserted into the slot 215. The cutaway portion of the paper 40 is then collected in the compartment 35 of the lower seat 30.

Figure 7:
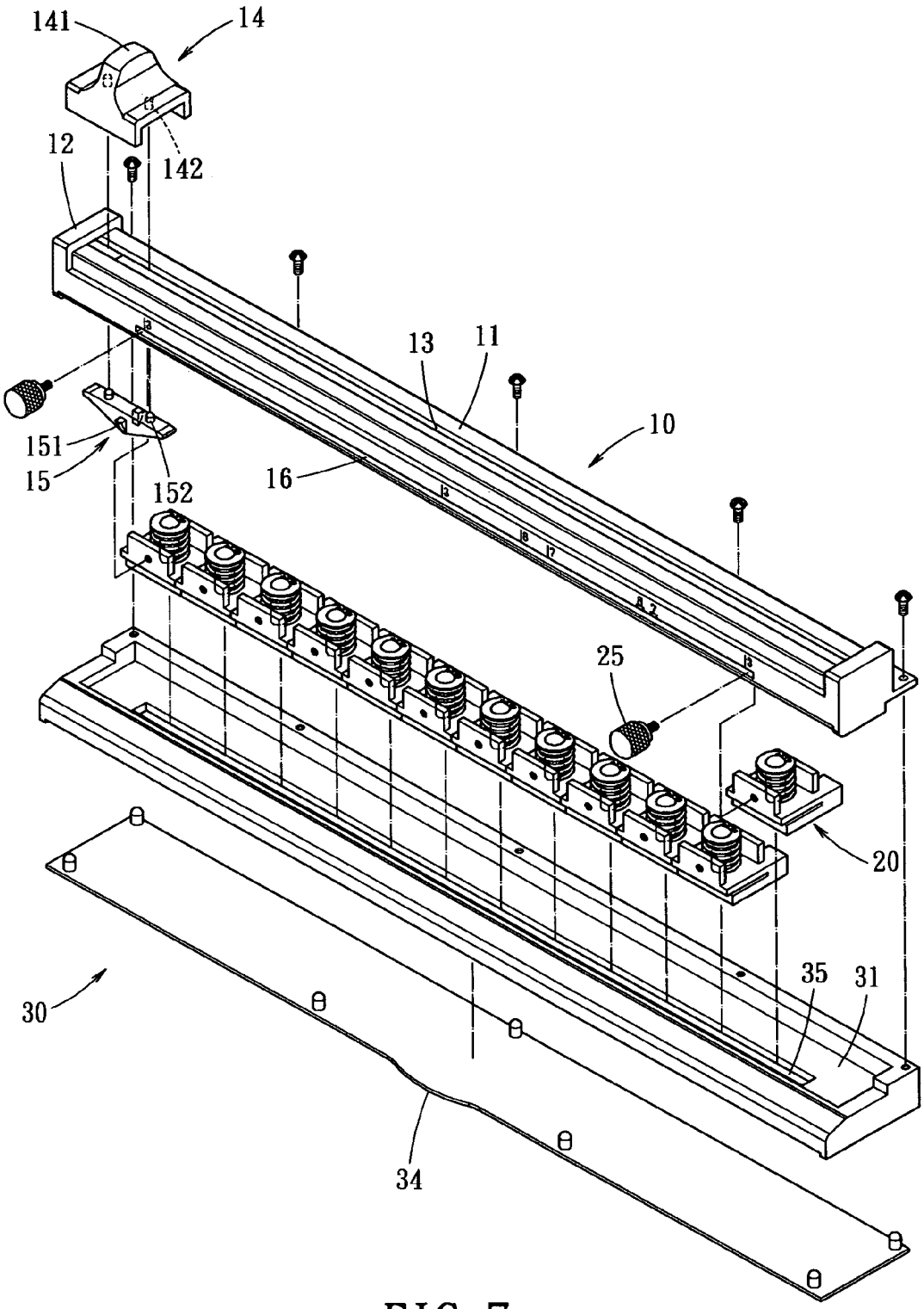
FIG. 7 shows the assembly of a hole punch in another embodiment of the present invention.

Referring to FIG. 7, another embodiment of the hole punch is illustrated. In this embodiment, multiple drills 20 are installed in the slot 31 of the lower seat 30. Each of the drill includes a positioning member 25, such that each drill can be adjusted to a specific desired position. By sliding the slide member through the slide track, paper disposed in the slot 215 can be punched with a plurality of holes.

Figure 8:
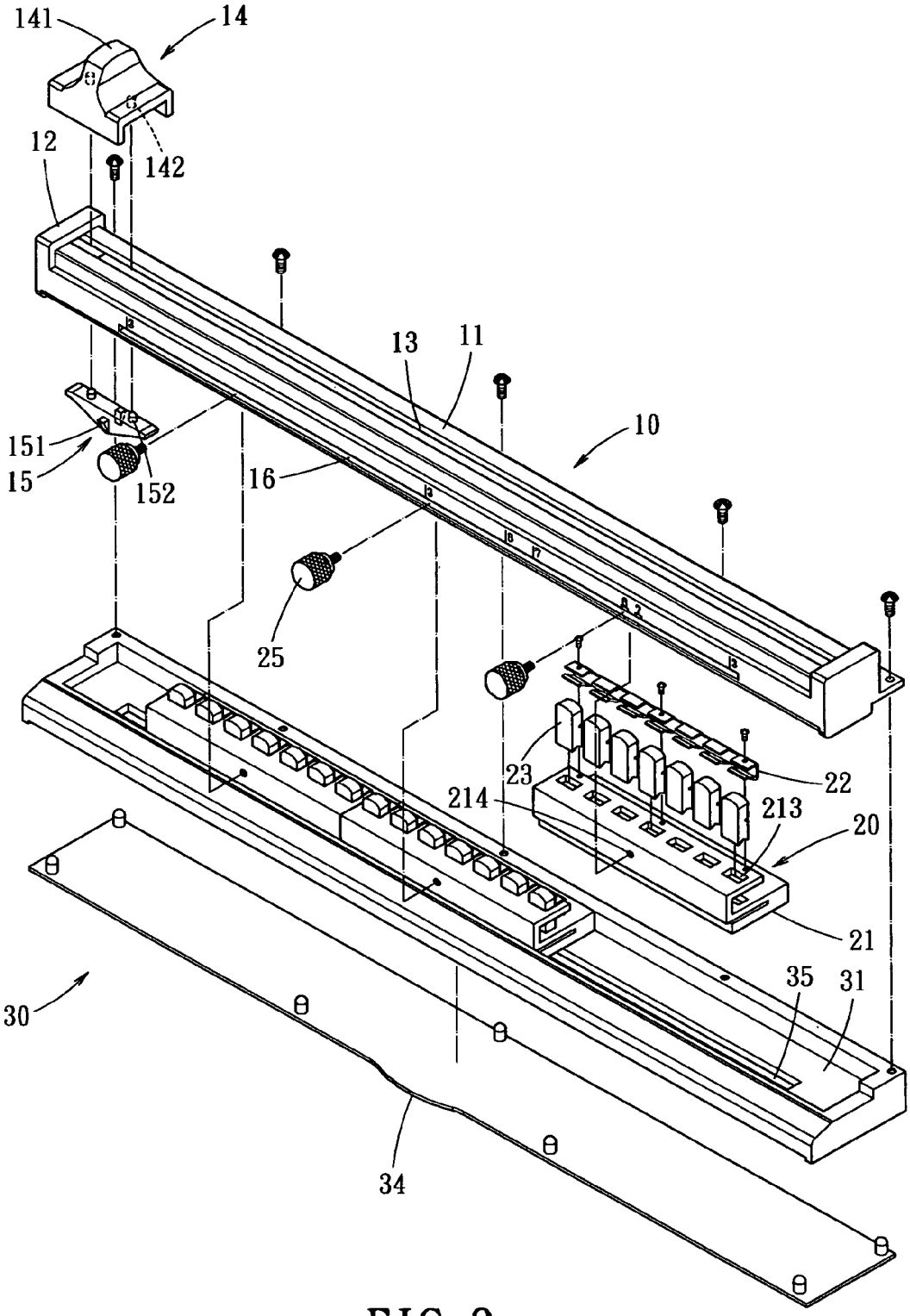
FIG. 8 shows the assembly of a hole punch in yet another embodiment.
Figure 9:
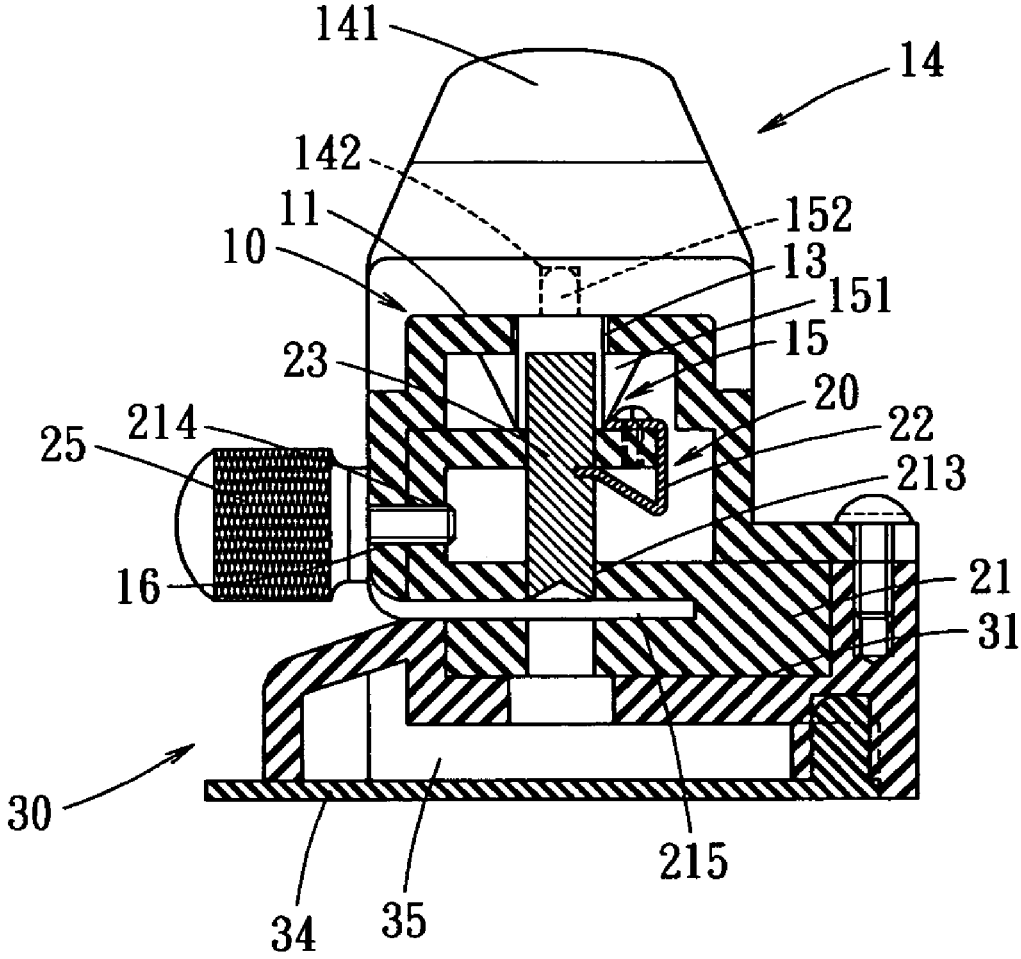
FIG. 9 shows a cross sectional view of the hole punch as shown in FIG. 8.

Referring to FIGS. 8 and 9, another embodiment of the hole punch is shown. As shown, the drill fitting base 21 includes a rectangular plate, and the plate 211 protruding from the drill fitting base 21 has an L shape. A plurality of holes 213 is formed along an elongate sidewall of the L-shape plate 211, and one end of an elongate resilient member 22 is mounted to the L-shape plate 211, and the other end of the resilient member 22 inserted into the drills 23 for restoring the position of the drills 23.

According to the above, the slidable hole punch provided by the present invention includes at least the following advantages.

1. The slanted surface of the slide member reduces the force required for punching paper. The paper punching process is easily performed by sliding the slide member.

2. The drills can be changed according to specification of paper to be punched or the hole to be punch. Further, the distance between the drills can also be adjusted to punch holes with desired distance.

3. The volume of the hole punch is reduced compared to the traditional hole punch.

This disclosure provides exemplary embodiments of the present invention. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed:

1. A slidable hole punch, comprising:

an upper seat, including an elongate slide track and a slide member slidable along the slide track;

a lower seat, with one side connected to one side of the upper seat, the lower seat including an elongate slot; and a drill set, installed between the upper seat and the lower seat, wherein the drill set includes at least one drill moveable within the slot, and the drill is pressed down when the slide member is slid in contact therewith.

2. The hole punch according to claim 1, wherein slide member includes an upper slide member and a lower slide member.

3. The hole punch according to claim 2, wherein the upper slide member includes a handle.

4. The hole punch according to claim 2, wherein the lower slide member includes a pair of slanting bottom surfaces to be in contact with the drill.

5. The hole punch according to claim 2, wherein the lower slide member has a triangle sidewall.

6. The hole punch according to claim 1, wherein the upper slide member includes a top surface perforated with the elongate slide track and two side surfaces perpendicular to the top surface.

7. The hole punch according to claim 1, wherein the drill has a cylindrical shape.

8. The hole punch according to claim 1, wherein the drill includes a parallelepiped structure.

9. The hole punch of claim 1, wherein the drill set includes a fitting part, and the upper seat has an elongate slot formed on a sidewall thereof, the fitting part is aligned with the elongated slot.

10. The hole punch of claim 9, wherein the fitting part is engaged with a positioning member.

11. The hole punch of claim 1, wherein the drill includes a semi-spherical tip.

12. The hole punch of claim 1, wherein the drill set includes a resilient member fitting around the drill.

13. The hole punch of claim 12, wherein the resilient member includes a spring.

14. The hole punch of claim 1, wherein the drill set includes a resilient member connected to the drill.

15. The hole punch of claim 1, wherein the drill set further includes:

a drill fitting base;

a drill positioning column protruding from the drill fitting base for receiving the drill therein; and a resilient member fitting around the drill positioning column.

16. The hole punch of claim 15, wherein the drill fitting base is perforated with a hole at a center aligned with the drill positioning column.

17. The hole punch of claim 15, wherein one side surface of the drill fitting base is recessed to form a paper slot.

* * * * *